US005676627A

United States Patent [19]

Howse

[11] Patent Number: 5,676,627

[45] Date of Patent: Oct. 14, 1997

[54] LEG EXERCISE AND STRENGTH TESTING MACHINE

[76] Inventor: Christopher N. Howse, 6680 Alabama Hwy. 69 North, Cullman, Ala. 35055

[21] Appl. No.: 603,877

[22] Filed: Feb. 22, 1996

[51] Int. Cl.[6] ..... A63B 21/08

[52] U.S. Cl. ..... 482/97; 482/112; 482/93

[58] Field of Search ..... 482/93, 94, 97, 482/111, 112

[56] References Cited

U.S. PATENT DOCUMENTS

| | | | |
|---|---|---|---|
| 2,680,967 | 6/1954 | Newman | 482/112 |
| 3,103,357 | 9/1963 | Berne | 482/97 |
| 3,587,319 | 6/1971 | Andrews | 482/112 |
| 3,659,844 | 5/1972 | Cummins | 482/97 |
| 4,266,766 | 5/1981 | Calderone | 482/97 |
| 4,357,010 | 11/1982 | Telle | 482/112 |
| 4,572,505 | 2/1986 | Kornhaus | 482/97 |
| 5,183,452 | 2/1993 | Bacon et al. | 482/97 |
| 5,230,676 | 7/1993 | Terauds | 482/111 |
| 5,372,556 | 12/1994 | Ropp | 482/97 |

*Primary Examiner*—Lynne A. Reichard

*Attorney, Agent, or Firm*—John C. Garvin, Jr.; James E. Staudt

[57] ABSTRACT

A machine for strengthening the leg muscles and for testing the strength of the leg muscles. The machine includes a platform having an actuator end and a weight support end. The platform is pivotally supported by a base. Weights are placed upon the weight support end of the platform. One foot of a standing user is placed upon the actuator end of the platform so as to pivot the platform on the base by the application of pressure by the leg of the user. A pneumatic control system is attached between the base and the platform to provide an adjustable resistance to the pivotal movement of the platform, and for recording the force applied to the platform by the user. An optional stabilizer attachment may be attached to the base for griping by the user to prevent the user from being lifted during applications of extreme force. Alternatively, additional resistance to pivoting of the platform may be provided by use of an elastic cord attachment which is attached to the actuator end of platform and griped by the user.

18 Claims, 4 Drawing Sheets

LEG EXERCISE AND STRENGTH TESTING MACHINE

BACKGROUND OF THE INVENTION

1. Field of the Invention

The invention relates primarily to a machine for testing strength and quickness of leg muscles and for exercising leg muscles.

2. Description of the Prior Art

In recent years there has been an increased awareness of physical fitness. Fitness trainers experience the age old dilemma of how to make strong athletes faster and fast athletes stronger. Athletic success is typically predicated on ones' ability to accelerate quickly, usually from a stationary or near stationary position. Such acceleration is often described as a power/explosion. To excel in such an effort requires a combination of leg strength and speed. Historically, power/explosion has primarily been assessed through the use of a vertical jump test. It is the powerful/explosive movement in a downward vertical direction that largely contributes to the explosive "first step" which is a critical component of athletic success in many sports. In addition, the powerful/explosive movement contributes to the movement patterns associated with the "gait" in running. The explosive "first step" and the movement patterns which contribute to the "gait" in running are associated with a wide variety of athletic events including: moving off the line of scrimmage in football; moving past a defender in basketball; coming out of the starting blocks in dashes; moving into a volley position in tennis; and moving out of the batters' box in baseball.

While machines for testing leg strength are less common, leg exercising equipment has been the subject of numerous devices, many of which have been patented. Examples of such patents include U.S. Pat. Nos. 4,149,715; 4,337,939; 4,502,680; 4,572,505; 4,577,861; 4,951,939 and 5,242,340.

In view of the above, it is apparent that no existing exercise equipment provides a device having a unique means for exercising the legs of a person to improve strength and quickness as well as for testing the results of the exercising.

SUMMARY OF THE INVENTION

To overcome the shortcomings of the above described prior art, the present invention provides a complete physical fitness device for building and testing the strength of leg muscles. Until the advent of the present invention there has been no effective means of accurately assessing both the power and explosiveness of a person's downward vertical leg movement. The present invention is uniquely designed for strengthening the muscles associated with a person's legs and for assessing powerful/explosive leg movement in a downward, generally vertical, direction. The term explosive as used herein is synonymous with terms such as speed or quickness.

The leg and foot movement described herein above is in the nature of a stomp. Accordingly for the sake of brevity the machine which is the subject of the invention is often referred to as the "STOMPER". More specifically the "STOMPER" allows the user to perform a forceful downward vertical movement of the sole of the foot in a manner that duplicates the movement patterns associated with the explosive "first step", as well as the "gait" in running. Thus, as the user forcefully moves the sole of the foot downward onto a pad, a weight is lifted and a gauge records the amount of pressure generated in a pneumatic system which is an integral part of the device. The more forceful or faster the movement of the leg and foot in a downward vertical direction, the higher the pressure gauge reading. Through the utilization of a variety of assessment techniques a comprehensive evaluation of an athlete's overall power/explosion, the "STOMPER" provides an important step in making strong athletes faster and fast athlete's stronger. Thus, the "STOMPER" is a unique machine designed primarily to test/assess downward vertical power/explosion. The results of the test are a measure of the downward force a person can exert upon a pivoted platform and are automatically recorded.

In its basic form, the "STOMPER" includes a platform, the mid point of which is pivotally mounted on a base. The platform has an actuator end and a weight retainer end. The "STOMPER" is primarily adapted to accommodate two testing scenarios and three discrete exercises. In the first of the testing scenarios resistance to the movement of the platform is caused by a weight at one end thereof. A pneumatic control system is attached between the base and the platform to provide an easily controlled additional resistance. The pneumatic system includes a gauge which serves to record the amount and speed of the downward force exerted by the user. This provides an accurate indication of not only the ability of the leg to raise the weight, but also of the speed at which the weight has been raised. An auxiliary attachment is used to anchor the user when his/her strength is sufficient to raise his/her body from the floor during the stomping action. In the second testing scenario a medicine ball is substituted for the weights at the weighted end of the platform. The stomping motion is then used to drive the medicine ball into the air. Measurement of the trajectory and distance which the ball travels serves as an approximate indicator of the strength and quickness of the stomping motion applied by the user. While this test does not provide the precise results attained by the first test which utilizes the pneumatic system, it does provide a competitive value for comparison of the strength and quickness of different users of the machine. The three exercises accommodated by the "STOMPER" include standard weight training, ankle weight lifting, and weight training wherein use is made of elastic tubes to increase the downward resistance and upward leg speed. Each of these exercises contribute to the improvement of a person's first step explosion as well as the person's running gate. In performance of the standard weight training exercise, weights are placed on the weighted end of the platform and a one leg downward press in the nature of a foot stomp is performed on opposite or actuator end of the platform so as to pivot the platform about its central axis. The ankle, weight lifting exercise is performed adjacent the weighted end of the levered platform and utilizes a raised cross member which is adapted for contact with the forward portion of the upper foot of the user. Lifting the weight with this portion of the foot develops the ankle muscles. An increase in the strength, power, and flexibility of the ankle will increase a persons leg speed and strength. Such an increase in ankle strength and speed will also cut down the time that the foot is in contact with the ground when running. In the third exercise, elastic cords such a surgical tubing are attached at one end thereof to the actuator end of the platform and are held at the other end by the user. The elastic cords provide an increase in the resistance to the downward movement of the actuator end of the platform and consequently an increase in the upward force which is exerted against the foot of the user. This force serves to assist in what is referred to as over-speed training.

This is training of the motor unit in the running gait to increase stride frequency. The training is accomplished as the tubing drives the extended leg back to the top position at a rate faster than could otherwise be attained by the user.

It is apparent from the above that this machine not only revolutionizes the way to test an athletes overall leg power but also provides training exercises which mimic specific motor patterns that are applicable to many sports. The need for increased speed and an explosive first step is paramount to an athlete's improvement in these sports.

DESCRIPTION OF THE PREFERRED EMBODIMENT

Figure 1:
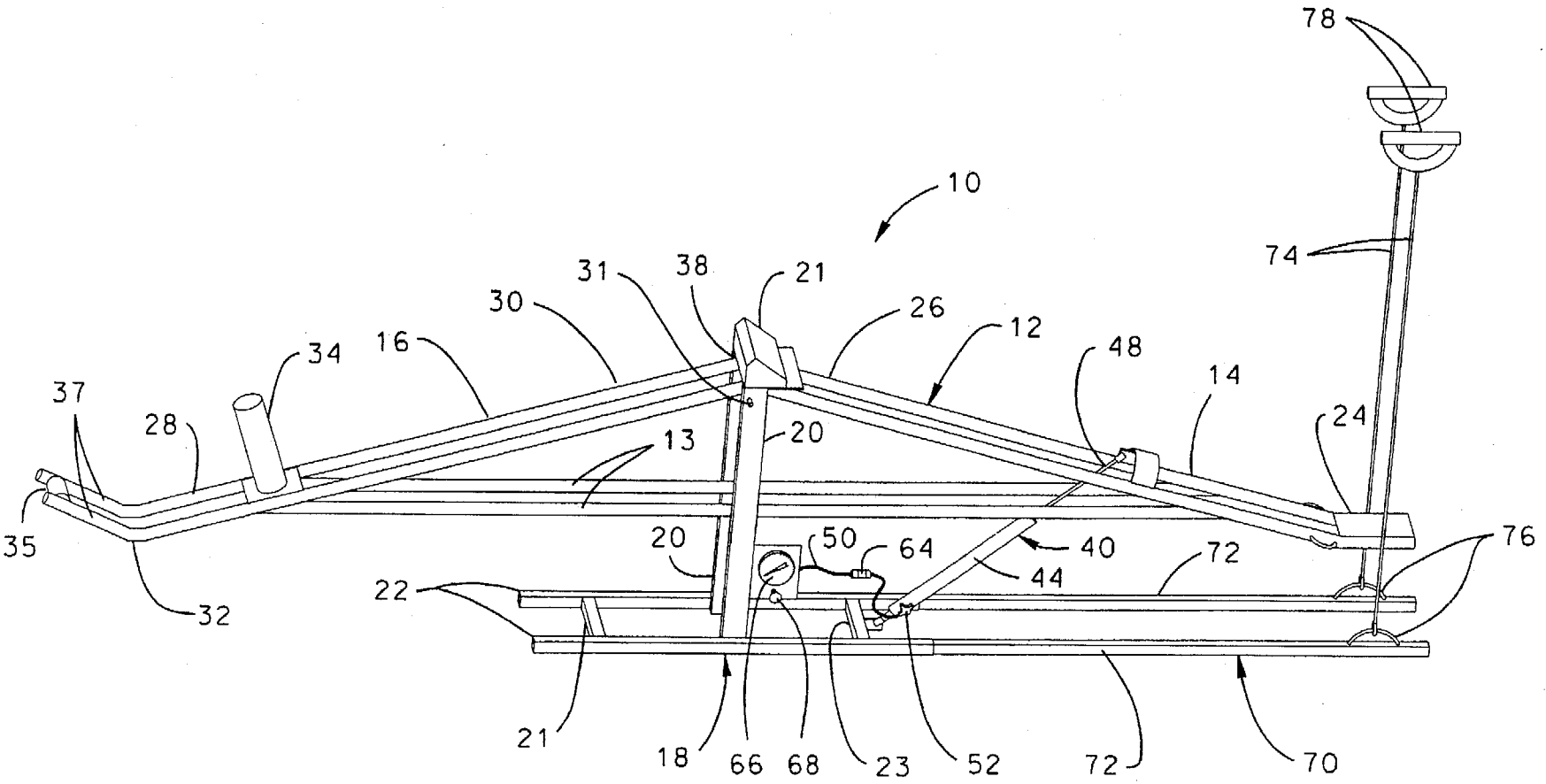
FIG. 1 is an elevational view of the device including an optional anchor attachment.
Figure 2:
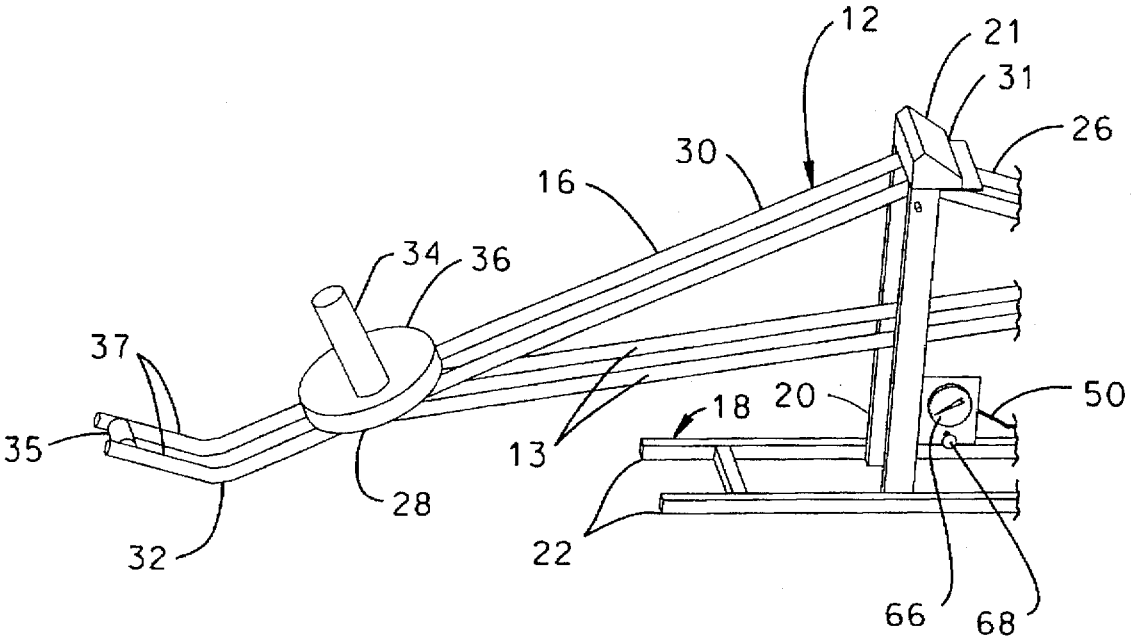
FIG. 2 is an enlarged fragmentary view of the weight retaining portion of the device and illustrates the configuration of a foot lift exercising feature of the device.
Figure 3:
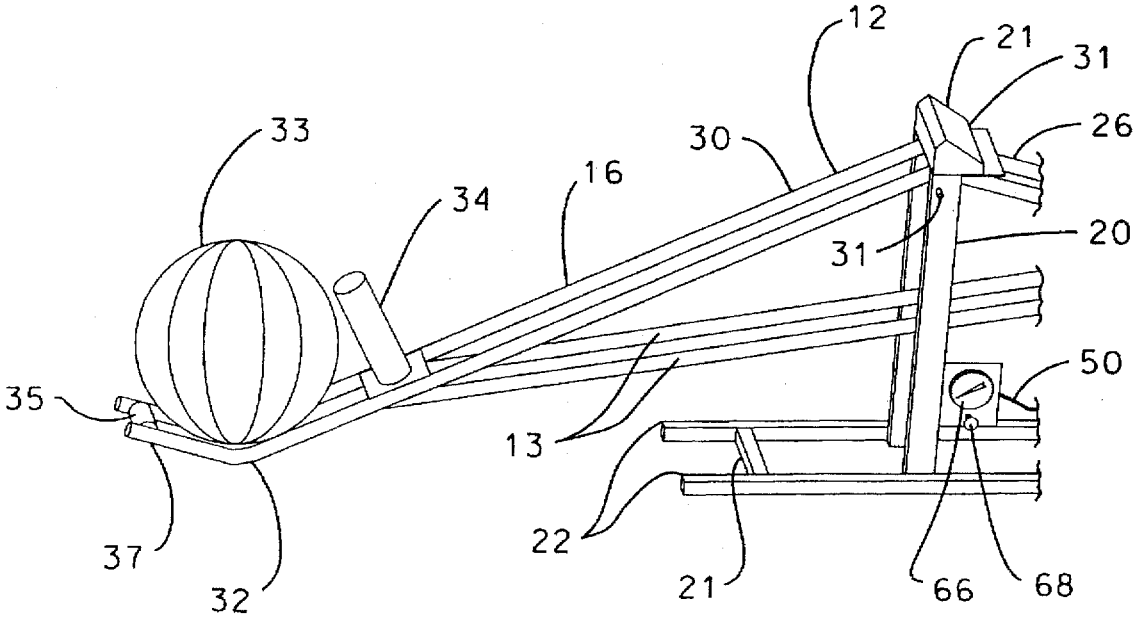
FIG. 3 is an enlarged fragmentary view of the weight retaining portion of the device and illustrates the use of a medicine ball as a weight.

Referring now to FIG. 1, a leg exercise and strength testing machine ("THE STOMPER") is indicated generally by the reference numeral 10. The machine 10 includes a platform 12 having an actuator arm 14 and a weight receiver arm 16. The platform 12 is pivotally supported by a base 18 which includes a pair of vertical stanchions 20 each connected to one of a pair of horizontal frame members 22. As illustrated in FIGS. 1 through 5, the horizontal frame members define a horizontal plane which is substantially coplanar with a floor or other support upon which the machine 10 may be placed. The frame members 22 are connected by lateral members 21 and 23 attached adjacent either end of the frame members 22. The actuator arm 14 includes a step end 24 and a connector portion 26. The step end 24 is positioned in an angular relationship to the remainder of the actuator arm 14 so as to best accommodate the foot of a person using the machine. The connector portion 26 is adapted for connection to the weight receiver arm 16 in a manner to be described hereinafter. The weight receiver arm 16 includes a weight receiver end 28 and a connector portion 30. The weight receiver end 28 includes a curved portion 32 which is adapted for reception of a weight such a medicine ball 33 in the manner illustrated in FIG. 3. The weight receiver end 28, further includes a generally vertically extending weight receptor 34 for reception of disc shaped weights having a center aperture of the type generally used in conjunction with weight lifting bars. Such weights are indicated by numeral 36 in FIG. 2. It will be understood that addition of weights 36 and/or the medicine ball 33 provide a first resistive means to create the chosen resistance to be encountered as the platform is pivoted about its axis by the user. A foot lift bar 35 connects upper ends 37 of the curved portion 32. The foot lift bar 35 is adapted for contact by the forward and upper portion of a persons foot. The bar thus provides a dorsi-flexion type device for exercising the ankle. It will be appreciated that in use of this foot lift bar 35, the weight 36 may be lifted by flexing the ankle or by lifting the entire foot vertically. The connector portion 30 of weight receiver arm 16 is adapted for rigid connection to the mating connector portion 26 of the actuator arm 14 so as to form an intermediate pivot portion 38 on the platform 12. It will be noted that actuator arm 14 and weight receiver arm 16 are joined in a non-planer relationship so as to form an obtuse angle. This unique angular configuration provides an effective geometric arrangement for accommodation of a raised pivot point area, an effective support structure (platform braces 13) and lowered ends 24,28 on the platform 12. The raised pivot area provides a balanced and stable machine by locating the end portions of the platform well below the pivot axle. This feature also provides the space and geometry needed to accommodate a pneumatic control system 40, the details of which will be provided hereinafter. The lowered ends 24,28 of the platform 12 are designed to provide the optimum height required for comfortable and effective use during leg tests and exercises. As illustrated in FIGS. 3 and 5 the lower ends 24 and 28, when in a "down" position are alternately lowered to substantially the horizontal plane as defined by the frame members 22. A pivot axle 31 is mounted between the stanchions 20 for pivotally mounting the platform 12 to the base 18.

As illustrated in FIG. 1 the machine 10 is provided with an optional anchor attachment 70. This attachment is removably attached to the base 18 by a pair of anchor supports 72, each of which is adapted to slide into one end of the hollow horizontal frame members 22. The anchor supports 72 are held in place by conventional friction means (not shown) within the horizontal frame members 22. A pair of anchor rods 74 (other means such as cables or ropes may also be used) are removably attached, one each, to one each of the anchor supports 72 by connector rings 76. A pair of user handles 78 are attached one each to the upper ends of each of the anchor rods 74. The anchor attachment 70 is for use by persons of above average strength to prevent their body from lifting during the "stomping" motion. It will be readily understood that by gripping the handles 78, one in each hand, the user of the machine may in effect be anchored to the base 18. If necessary base 18 may be attached to whatever surface upon which the machine is placed.

As illustrated in FIG. 5 an elastic chord attachment 80 is also provided as optional equipment for the machine 10. The attachment 80 consists of a pair of elastic cords 82, such as surgical tubing, attached at the upper ends thereof to a cross bar which is adapted for gripping by a user. At the lower ends, the elastic cords 82 are connected to cord snaps 86 which in turn are removably attached to cord connectors 88 which are integral with the actuator arm 14. Use of this elastic cord attachment provides not only an additional downward resistance to the stomping movement but also brings into play the exercising of the muscles of the hands, arms upper body and back.

Figure 4:
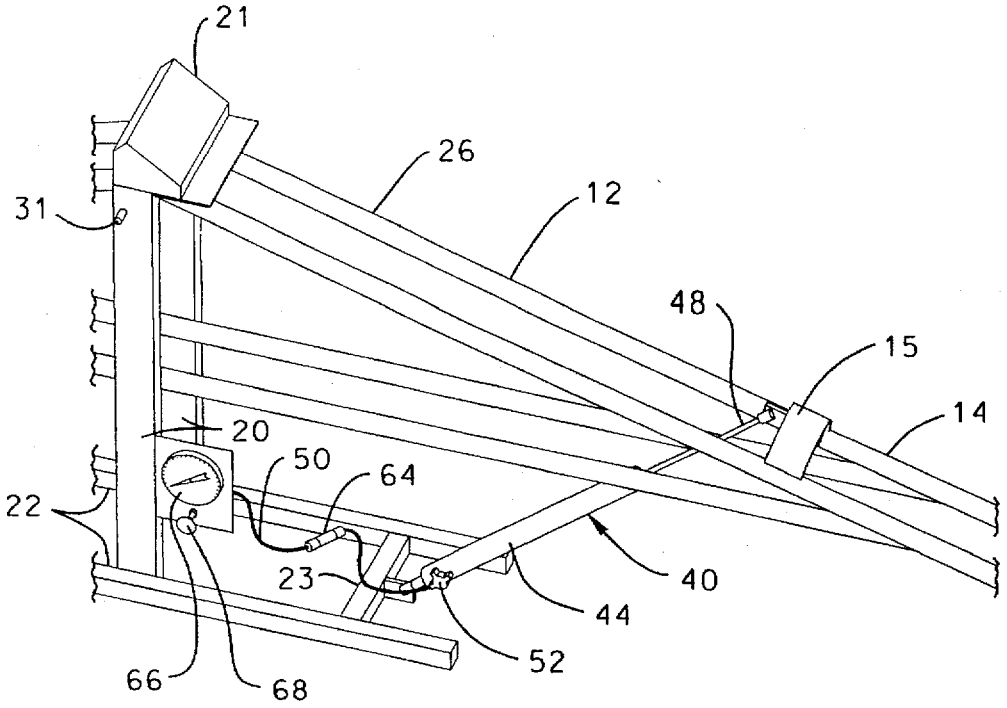
FIG. 4 is an enlarged fragmentary view of the base of the device, and includes details of the pneumatic control system utilized on the device.
Figure 5:
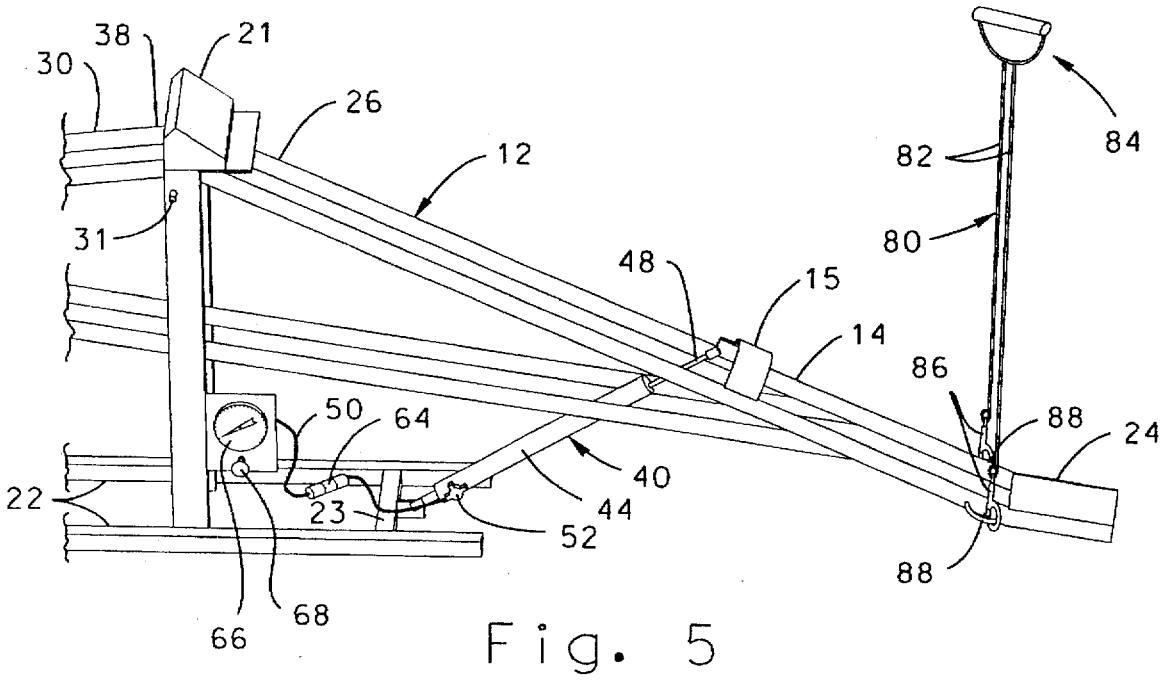
FIG. 5 is an enlarged fragmentary view of the actuator end of the device and illustrates the use of an elastic cord attachment connected to the actuator end of the platform.
Figure 6:
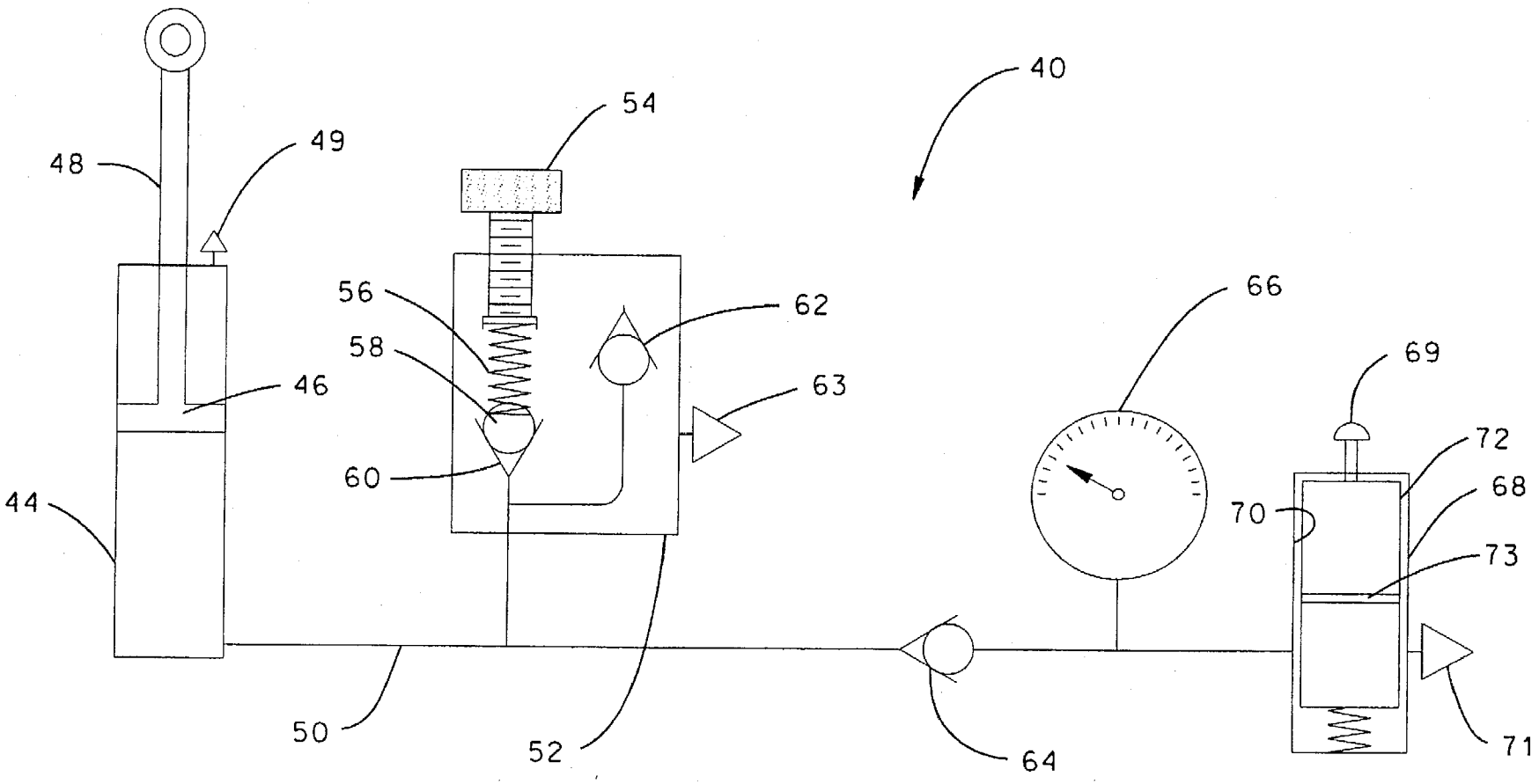
FIG. 6 is a diagrammatic illustration of the pneumatic control system of the device.

As illustrated in FIGS. 1–5, the functionality and versatility of the exercise and strength testing machine are uniquely enhanced by use of a second resistive means which consists of a pneumatic resistance control system 40. This system is pivotally attached between the actuator arm 14 and lateral frame member 23. As illustrated in FIG. 6 the pneumatic resistance control system 40 includes a single acting pneumatic cylinder 44 which houses a piston 46. The piston 46 is actuated by a piston rod 48 which is connected to actuator arm 14 by a support bracket 15 (FIG. 4). It will be further noted that the cylinder 44 is vented to the atmosphere by an open vent 49 (FIG. 6) at the rod end of the cylinder and is connected to a pneumatic line 50 at the opposite end thereof. A control valve housing 52 contains an exhaust valve control 54, rotation of which controls the pressure upon a valve spring 56, which in turn provides a bias against a valve ball 58 upon valve seat 60. The exhaust valve control 54 allows air to escape from the system at a controlled rate which is less than the rate at which air is pressurized by the cylinder action as the cylinder volume is reduced by the stomping motion of the user. As this sequence occurs, it will be readily understood that the pressure rises within the pneumatic system. As the exhaust valve control 54 allows the desired amount of air to escape from the system, a pressure relationship is created between the air escaping through the valve seat 60 and the speed at which the air cylinder is collapsed. It will also be understood that the faster the cylinder is collapsed by the user the greater will be the pressure in the system. The control valve housing 52 also permits reverse flow through a reverse flow check valve 62 as the platform 12 returns to its starting position. The cylinder is thus refilled with air during the reverse cycle. The control valve housing is vented to the atmosphere by vent 63 which provides intake air for passage through reverse flow valve 62 and also permits exhausting of air which is forced through valve seat 60 and around valve ball 58. A pressure retainer check valve 64 retains the pressure attained in that portion of the system which is down stream therefrom. A pressure gauge 66 indicates the amount of the retained pressure. A manual push button relief valve 68 includes a cylinder 70 within which a piston 72 is contained. The piston 72 is provided with an air passage 73 and is sealably and movably fitted within the cylinder 70. It will be noted that downward actuation of a push button 69 aligns the air passage 73 with airline 50 and an air vent 71 for release of retained air pressure through exhaust vent 71. As the retained air is released the gauge 66 returns to zero.

In operation of the machine 10 for exercising, a weight of desired amount is placed upon the weight receiver end 28 of the weight receiver arm 16. The user places one foot upon the step end 24 of the actuator arm 14, and applies pressure to the actuator arm so as to pivot the platform 12 about axle 31 which is supported by base 18. If desired, resistance to the pivoting of the platform may be varied by the addition of weight to the weight receptor 34 and/or by adjustment of the exhaust valve control 54 of the pneumatic control system 40. Additionally, the optional elastic cord attachment 80 (FIG. 5) which serves as a leg return booster may be attached at one end to the step end of the platform and held at the distal ends in the hands of the user. Use of this attachment provides an additional resistance to the downward movement to the step end of the platform 12, as well as a springing force which aids in the upward leg movement of the user. The attachment 80 also provides a unique combination of leg exercise with an exercise of the hand, arm shoulder and back muscles.

In operation of the machine for the strength testing, weight is added to the weight receiver end 28 of the platform 12 in accordance with the strength of the user. Typically, this weight would be approximately ten percent of the body weight of the user. The user then applies the maximum force possible to the step end 24 of the platform 12. In response to this force, the platform pivots about the axle 31 thereby actuating the pneumatic control system 40. A reading of the maximum pressure attained within the system is recorded on the pressure gauge 66. The weight, as well as the exhaust control valve 54 may be adjusted between each test to obtain the desired resistance to actuation of the platform 12. These variations in resistance provide a means for comparisons between the strength and the speed of the stomping motion of a user. This sequence may be repeated until a maximum pressure readout at a selected setting of the exhaust control valve is attained by the user while using the desired weight. The weight amount and the maximum pressure attained are then combined to calculate the strength and quickness of the user. In the case of users having exceptional strength the optional anchor attachment 70 (FIG. 1) may be fixed to the base 18. As described supra, by grasping the handles of the anchor attachment, the user is able to eliminate the possibility of lifting his/her body from the floor. In this way the maximum force applied by the user may be readily measured.

Thus it is understood that a preferred embodiment of the present invention is disclosed which achieves the objectives of the invention as set forth above. However, it should be appreciated that this invention may be implemented in types of equipment other than those disclosed. Variations may also be made with respect to the best mode of practicing this invention without departing from the scope of the invention as set forth in the appended claims.

I claim:

1. A machine for indicating individually the strength of each of a person's leg muscles, said machine comprising:

a platform including an actuator arm having a step end and an actuator connector portion, said platform further including a weight receiver arm having a weight receiver end and a weight receiver connector portion, said actuator arm and said weight receiver arm being attached to one another in non-planar relation at the respective connector portion of each said arm so as to form an intermediate pivot portion on said platform;

base means having horizontal frame members and vertical stanchions attached thereto, said vertical stanchions being adapted for pivotal attachment to the intermediate pivot portion of said platform so as to pivotally support said platform for movement of said step end from a normally raised position suitable for accommodation of the raised foot of a person in preparation for a downward stepping action, to a downward position adjacent a horizontal plane as defined by said horizontal frame members; whereby pivoting of said platform may be accomplished by a person stepping downwardly on said step end with one foot so as to raise said weight receiver end.

2. A machine as set forth in claim 1 and further including first and second resistive means, for providing resistance to the pivoting of said platform.

3. A machine as set forth in 2 wherein each said first and second resistive means includes controlling means for controlling the amount of said resistance.

4. A machine as set forth in claim 3 wherein said first resistive means includes weight means removably attached to said weight receiver end.

5. A machine as set forth in claim 4 wherein said second resistive means includes a pneumatic resistance control system.

6. A machine as set forth in claim 3 wherein said second resistive means includes a pneumatic resistance control system.

7. A machine as set forth in claim 6 wherein said pneumatic resistance control system is attached between said base means and said platform, and wherein said pneumatic resistance control system is adjustable so as to selectively control said resistance to pivoting of said platform by the compression and controlled release of air within said pneumatic resistance control system.

8. A machine as set forth in claim 1 wherein said platform is formed as an obtuse angle.

9. A machine for testing the strength of the leg muscles of a person, said machine comprising: an elongated platform including an actuator arm having a step end for downward actuation by the foot of a person, a weight receiver arm for reception of weights, first and second resistance means for providing resistance to said actuation, and an intermediate portions, said actuator arm and said weight receiver arm being attached to one another within said intermediate portion of said platform so as to provide a pivotal support for said platform; a base having horizontal frame members which delineate a horizontal plane, and vertical stanchions attached to said horizontal frame members, said vertical stanchions being pivotally attached to said intermediate portion so as to pivotally support said platform for movement of said step end from a normally raised position suitable for accommodation of the raised foot of a person in preparation for a downward stepping action, to a downward position adjacent the horizontal plane of said horizontal frame members whereby pivoting of a platform may be accomplished by said person stepping downwardly on said step end with one foot so as to raise said weight receiver end.

10. A machine as set forth in claim 9 wherein said actuator arm and said weight receiver arm are connected so as to form an obtuse angle.

11. A machine as set forth in claim 9 wherein one said resistive means is attached between said base and said platform for providing adjustable resistance to said actuation.

12. A machine as set forth in claim 9 wherein said one resistive means includes a pneumatic control system having a piston and cylinder assembly pivotally attached between said base and said platform and disposed for compression of air during actuation of said actuator arm; indicator means for indicating the degree of compression of said air; means pneumatically interconnecting said cylinder assemble to said indicator means; valve means for controlling release of said compressed air; check valve means for retaining said compressed air within said indicator means.

13. A machine as set forth in claim 9 including an elastic means attached at one end thereof to said actuator arm and adapted at the other end thereof for retention by a person using said machine.

14. A machine as set forth in claim 9 including anchor means having an attachment end and a free end; said anchor means attached at said attachment end to said base and adapted at said free end to be gripped by a person using said machine.

15. A machine as set forth in claim 9 wherein said weight receiver arm further includes a weight receiver end having an generally upwardly extending weight receptor disposed for reception of disk shaped weights having center apertures therein.

16. A machine for testing the strength of the leg muscles of a person, said machine comprising: an elongated platform having an actuator arm for downward actuation by the foot of a person; a weight receiver arm having a weight receiver end, said weight receiver end having a generally upwardly extending weight receptor disposed for reception of disk shaped weights having apertures therein and an upwardly curved distal end portion terminating with an upper end portion disposed for generally fitted reception of a weighted ball; first and second resistance means for providing resistance to said actuation; and an intermediate portion; said actuator arm and said weight receiver arm being attached to one another within said intermediate portion of said platform so as to provide a pivotal support for said platform; a base having support means pivotally attached to said intermediate portion.

17. A machine as set forth in claim 16 wherein said upper end portion includes a foot bar disposed for engagement with the upper forward portion of a persons foot so as to facilitate lifting of said upper end portion of said weight receiver arm by raising the forward portion of the foot.

18. A machine as set forth in claim 17 wherein said actuator arm includes a step end for accommodation of the foot of a person and disposed in angular relationship to the remainder of said actuator arm so as to be generally horizontal when said actuator arm has been actuated to a maximum downward position.

* * * * *